United States Patent [19]

Sutton

[11] Patent Number: 5,042,815

[45] Date of Patent: Aug. 27, 1991

[54] GOLF SWING ALIGNMENT DEVICE

[76] Inventor: Harold Sutton, 5377 Limerick Ave., San Diego, Calif. 92117

[21] Appl. No.: 668,236

[22] Filed: Mar. 12, 1991

[51] Int. Cl.[5] ..... A63B 69/36

[52] U.S. Cl. ..... 273/187 R; 273/DIG. 21

[58] Field of Search ..... 273/187, 187 A, 187 B, 273/183 A, 195 R, 195 A, 195 B

[56] References Cited

U.S. PATENT DOCUMENTS

| | | | |
|---|---|---|---|
| 3,580,584 | 5/1971 | Trosko | 273/187 R X |
| 3,685,835 | 8/1972 | Fahy | 273/187 R X |
| 4,478,422 | 10/1984 | Blanchard | 273/187 R |

*Primary Examiner*—George J. Marlo

*Attorney, Agent, or Firm*—Nydegger & Associates

[57] ABSTRACT

A grid-like reference system for obtaining a properly aligned golf stance includes a plurality of lines and a plurality of frames for holding opposite ends of each line on the ground in a predetermined relationship. A stance position line is established which extends from in front of the golfer and under the golf ball to behind the golfer to reference placement of the golfer's heels. A toe alignment line is established substantially perpendicular to the stance position line as a reference for placement of the golfer's toes and, a pair of substantially parallel swing plane lines are established to straddle the golf ball to direct the swing of the golf club.

4 Claims, 2 Drawing Sheets

GOLF SWING ALIGNMENT DEVICE

FIELD OF THE INVENTION

The present invention pertains generally to training aids and devices. More particularly, the present invention pertains to devices which are useful for improving a golf swing. The present invention is particularly, but not exclusively useful for helping to improve the stance of a golfer while the golfer is executing a golf swing.

BACKGROUND OF THE INVENTION

As is well known to anyone who has ever held a golf club and swung it with the intent of hitting a golf ball, there are many aspects of body position and movement which must be controlled to properly and effectively perform this task. To do so, however, requires some skill and much concentration. For example, the grip of the hands on the handle of the golf club must be firm and properly positioned. Further, the golfer must properly "address" the ball. The golfer's head must be properly positioned and his/her eyes must be directed to the ball. The golfer's shoulders must be properly set and the legs bent in a precise manner. Indeed, volumes have been written about the golf swing and what a golfer should do to perfect it. All is for naught, however, if you have no idea where the golf ball will go when it is hit.

It is known that the most important factor in directing the flight of a golf ball is the positioning of the feet relative to the golf ball, i.e. the stance of the golfer. Not only does the golfer's stance generally determine the direction in which the golf ball will go when hit, it also has an effect on the spin which is imparted to the ball when it is hit by the golf club. Whether you want to "hook" or "slice" the ball, and how much you want to do so, is somewhat a function of stance. In any event, the stance of the golfer is important. Fortunately, the proper positioning of the feet is an essentially mechanical function which, when mastered, can leave the golfer free to concentrate more specifically on other aspects of the golf swing.

The present invention recognizes that a golfer's stance is basically a matter of properly orienting the golfer's body relative to the golf ball and the direction in which the golfer desires to hit the ball. The present invention also recognizes that a ground based reference system can be established for training purposes which will give the golfer an opportunity to compare different stances and the effect these stances have when different clubs are used to accomplish different golf shots.

In light of the above it is an object of the present invention to provide a training aid which will assist the golfer to establish a proper stance during a golf swing. It is another object of the present invention to provide a golf training aid which is easily set up and easily moved to permit repetitive uses of the training aid in different locations and under different circumstances. Still another object of the present invention is to provide a golf training aid which is simple to use, relatively easy to manufacture and comparatively cost effective.

SUMMARY OF THE INVENTION

A device for establishing an aligned stance for a golfer as the golfer swings a golf club to hit a playable golf ball includes a plurality of frames which can be separately and selectively placed on the ground to each hold the end of a line. A plurality of these lines are then attached between various frames to create a grid-like reference system on which the golfer can place his/her feet relative to the location of the golf ball, i.e. establish his/her stance. More specifically, this reference system includes a stance position line which extends from in front of the golfer and under the ball to behind the golfer. The golfer uses this stance position line for proper placement of the heels of his/her feet. The reference system also includes a toe alignment line which is oriented substantially perpendicular to the stance position line. This toe alignment line is located between the golfer and the ball for proper positioning of the golfer's toes. Specifically, the toe alignment line is directed toward the target area where the golfer desires to hit the golf ball. Also included in the grid-like reference system are a pair of substantially parallel swing plane lines which straddle the golf ball and are oriented traverse and at an oblique angle to the stance position line. As intended for the present invention, each line can be established using a simple string.

The frames used to hold the ends of the lines include a metal member and a rubber strip which is fixedly attached to the metal member. Further, the rubber strip is formed with a plurality of slits which extend along the length of the strip and which are exposed to receive and engage with an end of a line. The metal member of the frame is angled so that, if desired by the golfer, a portion of the frame can be slipped under the edge of a golf swing practice mat. This anchors the frame to the mat and leaves the slits of the strip exposed for engagement with an end of a line. Alternatively, the frame is formed with an anchor hole through which a pin, such as a golf tee, can be inserted to anchor the frame to the ground. In either case, the frames hold the lines against the ground (or the mat if used) to provide a grid-like reference system on which the golfer can orient his feet for a proper golf stance.

In another embodiment of the present invention, the frames can be made of wood or plastic. Additionally, the frames can be fabricated without using a rubber strip. When a rubber strip is not used, the plurality of slits are formed directly on the frame.

The novel features of this invention, as well as the invention itself, both as to its structure and its operation will be best understood from the accompanying drawings, taken in conjunction with the accompanying description, in which similar reference characters refer to similar parts, and in which:

Figure 2A:
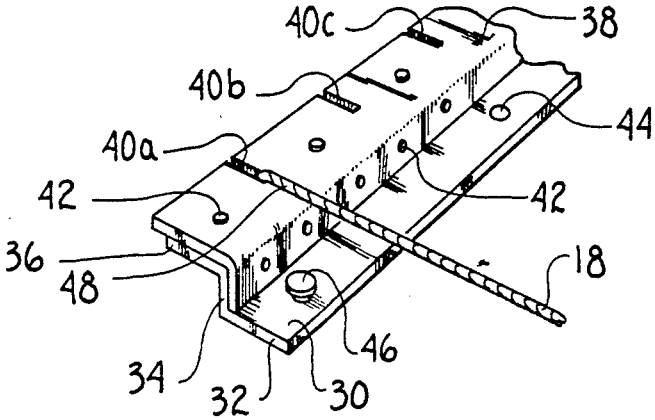
FIG. 2A is a perspective view of a portion of one embodiment of a frame according to the present invention including a rubber strip and known engaged with the end of a line.
Figure 3A:
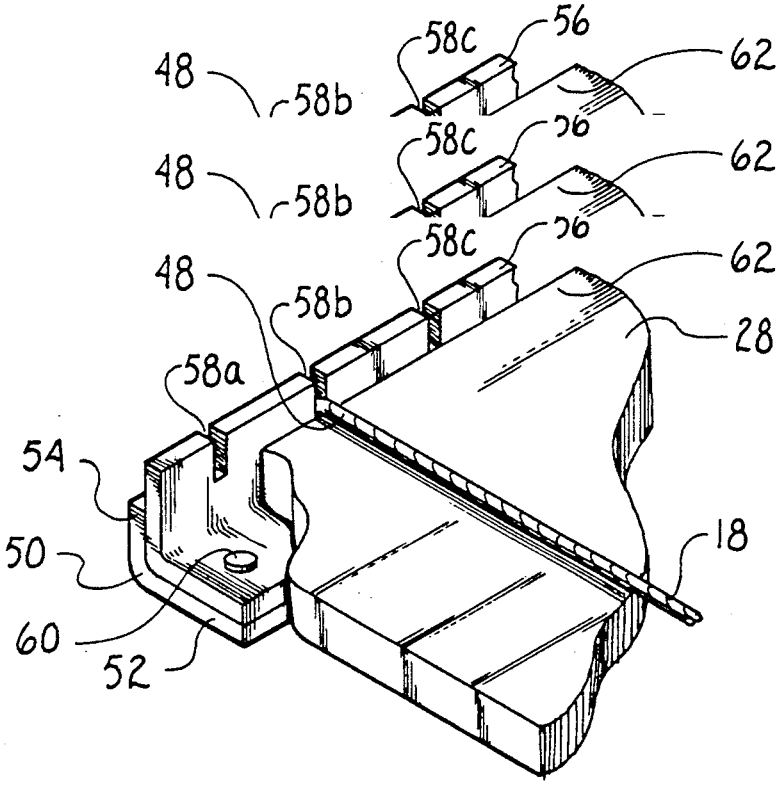
Figure 3B:
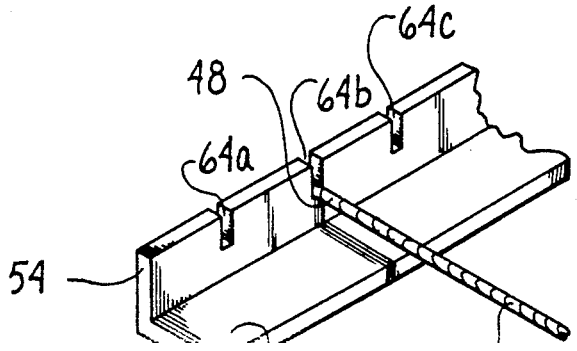

FIG. **2*b* is a perspective view of the frame shown in FIG. 2A** with the rubber strip removed;

FIG. 3A is a perspective view of a portion of another embodiment of a frame according to the present invention including a rubber strip and shown anchored under the edges of a golf swing mat, with portions broken away for clarity, and with the frame engaged with the end of a line; and FIG. 3B is a perspective view of the frame shown in FIG. 3A with the rubber strip removed.

DESCRIPTION OF THE PREFERRED EMBODIMENTS

Figure 1:
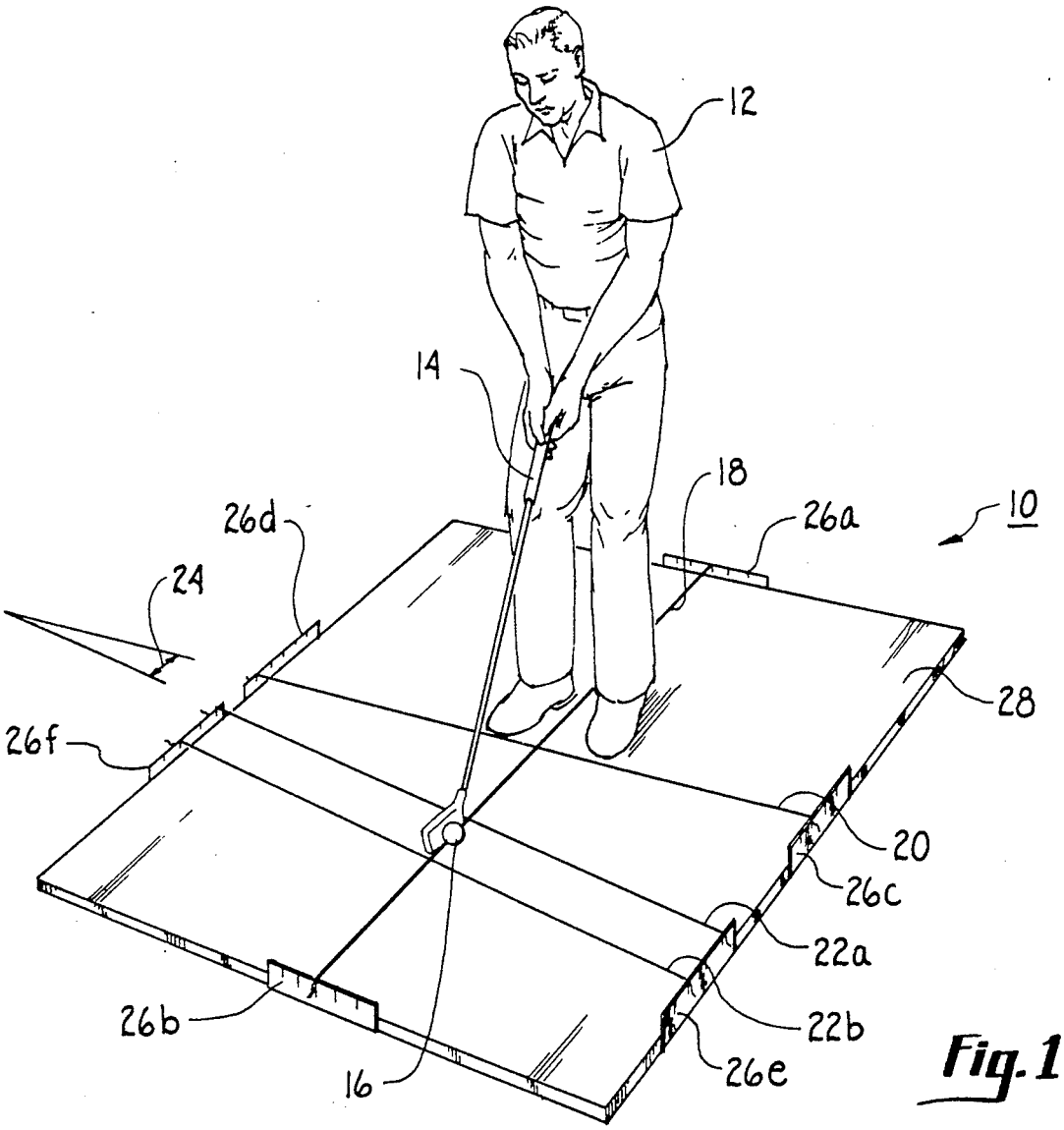
FIG. 1 is a perspective view of a golfer standing over the device of the present invention to establish an aligned stance for swinging a golf club.

Referring initially to FIG. 1 the grid-like reference system according to the present invention is shown in perspective and generally designated 10. A golfer 12 is shown standing relative to the system 10 in an aligned stance for swinging a golf club 14 to hit a golf ball 16. As shown, the system 10 of the present invention includes a stance position line 18 which extends from in front of the golfer 12 and under the ball 16 to behind the golfer 12. A toe alignment line 20 is also shown which is oriented substantially perpendicular to the stance position line 18. As intended for the present invention, the toe alignment line 20 is aligned and directly toward the target area where the golfer 12 desires to hit the golf ball 16. Further, a pair of substantially parallel swing plane lines 22*a* and 22*b* are shown to straddle the ball 16. Additionally, the swing plane lines 22*a* and 22*b* are shown to be slightly angled in their relationship with the toe alignment line rather than being parallel thereto. This is so because, with a properly executed golf swing, the club 14 will travel in a plane which intersects a vertical plane through the toe alignment line 18. The angle 24 is representative of this relationship and, as Will be appreciated by the skilled golfer, the angle 24 will vary between golfers and can be varied in accordance with the desires of the particular golfer 12.

FIG. 1 also shows that a plurality of frames 26*a–f* are selectively positioned on the periphery of a golf practice mat 28. As intended for the present invention, the frames 26*a–f* are positioned to hold the ends of the various lines that create the grid-like system 10. Further, portions of the frames 26*a–f* can be slipped under the mat 28 to anchor the frames 26*a–f* to the edge of mat 28. Specifically, as shown in FIG. 1, the frames 26*a* and 26*b* are engaged with respective opposite ends of the stance position line 18. The frames 26*c* and 26*d* are engaged with respective opposite ends of the toe alignment line 20, and the frames 26*e* and 26*f* hold the opposite ends of the swing plane lines 22*a* and 22*b*. As intended for the present invention, each of the lines 18, 20, and 22*a,b* can be a string or any suitable substitute well known in the pertinent art.

FIG. 2A shows that each of the frames 26*a–f* can include a substantially z-shaped member 30 which is preferably made of a sturdy material, such as metal, wood or plastic, and which is formed with a base 32, an upright section 34 and a flange 36. A rubber strip 38 having a plurality of slits 40 spaced along one of its edges is attached to member 30 by any means well known in the art, such as by tacks 42. As illustrated in FIG. 2A, the strip 38 is held against the upright 34 and the flange 36 with the slits 40 extending beyond the flange 36. Preferably, the base 32 also has a plurality of holes 44 through which a respective pin 46 can be inserted to anchor the frame 26 to the ground. For the purposes of the present invention, pin 46 can be any conveniently available device, such as a golf tee. In accordance with the present invention, once a frame 26 has been anchored to the ground, or alternatively to a mat 28, the end of a line can be attached to the frame 26. For example, in FIG. 2A, an end 48 of the stance position line 18 is shown engaged and held by the slit 40*a* of strip 38.

Figure 2B:
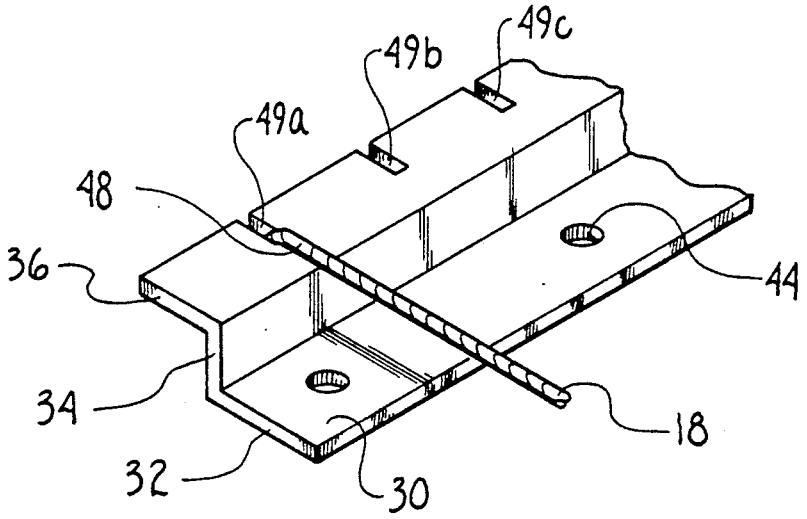

FIG. 2B shows another embodiment for the frame 26 using a Z-shaped member 30. In this embodiment, the rubber strip 38 is removed and the flange 36 of member 30 is formed with a plurality of slits 49 *a,b,c*. As shown for this embodiment, the end of a line (e.g. line 18) is attached directly into the slit 49*a*.

For an alternate embodiment of frame 26, as shown in FIG. 3A, the frame 26 can include a substantially L-shaped member 50 which is preferably metal and which is formed with a base 52 and an upright section 54. A rubber strip 56 having a plurality of slits 58 spaced along one of its edges is attached to the member 50 by any means well known in the art, such as by tacks 60. In this alternate embodiment, the rubber strip 56 is held against both the base 52 and the upright 54 and its edge which is formed with the slits 58 extends above the upright 54. For illustrative purposes, the mat 28 is shown engaged with the frame 26 in FIG. 3A. As shown, this engagement is accomplished by slipping the base 52 under the edge 62 of mat 28. Then, the selected line can be engaged and held by the frame 26. For example, as shown in FIG. 3A, the end 48 of stance position line 18 is engaged and held by the slit 58*b* of strip 56.

FIG. 3B shows an embodiment of a frame 26 using an L-shaped member 50 in which the rubber strip 56 has been removed. With rubber strip 56 removed, the upright 54 is formed with a plurality of strips 64 *a,b,c* substantially as shown. Accordingly, any line 18 (e.g. line 18) can be attached directly into a selected strip 64 *a,b,c*.

It is to be appreciated that either a Z-shaped member 30 or an L-shaped member 50 can be used in the manufacture of a frame 26. Further, it is to be appreciated that either can be used with, or without, a mat 28. Thus, when a mat 28 is used with a frame 26 having a z-shaped member 30, the edge 62 of mat 28 will rest on base 32 in a manner similar to that shown for the L-shaped member 50 in FIG. 3 where edge 62 rests on the base 52. Likewise, the base 52 of member 50 can be formed with holes (not shown) through which pins can be inserted, as disclose above, to anchor the member 50 directly to the ground. Additionally, it is to be appreciated that the rubber strip 38 can be removed from the Z-shaped member 30, and the rubber strip 56 can be removed from the L-shaped member 50, in alternate embodiments of the present invention.

Once the various frames 26 have been positioned and anchored, and the various lines 18, 20, and 22*a,b* have been attached to the appropriate frames the grid-like reference system 10 is created. The golfer 12 can then position his/her toes on the toe alignment line 20 and position his/her heels relative to the stance position line 18 to obtain a properly aligned golf stance. Once positioned, the golfer 12 then uses the swing plane lines 22*a,b* to assist in guiding the golf club 14 for hitting the ball 16.

While the particular ground based reference system for establishing a selected foot position for a golfer to swing a golf cub and hit a playable golf ball as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A device to establish an aligned stance for a golfer when swinging a golf club to hit a playable golf ball which comprises:

a mat;

a flexible cord;

means for establishing a toe alignment line;

means for establishing a stance position line substantially perpendicular to said toe alignment line; and means for establishing a swing plane line, said swing plane line being oriented transverse and at an oblique angle to said stance position line, a pair of frames, each said frame including means for adjusting the positions of the opposite ends of said cord along opposite sides of said mat;

2. A device as recited in claim 1 wherein said cord forms said toe alignment line.

3. A device as recited in claim 2 wherein said stance position line also is a flexible cord and said device further comprises a second pair of frames, each said frame of said second pair being attachable to an end of said stance position cord for holding said stance position cord on the ground.

4. A device as recited in claim 3 further comprising a second swing plane line to establish, with said swing plane line, a pair of substantially parallel swing plane lines straddling said golf ball to indicate a plane for swinging said golf club, said swing plane line and said second swing plane line each being a flexible cord, and a third pair of frames each of which is attachable to an end of said swing plane cord and an end of said second swing plane cord to hold said pair of swing plane cords in a substantially parallel relationship against said mat.

* * * * *